United States Patent [19]

Nishiyama

[11] Patent Number: 4,928,412

[45] Date of Patent: May 29, 1990

[54] DECORATIVE CUP

[76] Inventor: Gary S. Nishiyama, 12103 Culver Blvd., Los Angeles, Calif. 90066

[21] Appl. No.: 160,487

[22] Filed: Feb. 24, 1988

[51] Int. Cl.[5] ..... G09F 3/00

[52] U.S. Cl. ..... 40/324; 40/326; 40/406; 40/409; 446/197; 446/267

[58] Field of Search ..... 40/324, 326, 334, 406, 40/407, 409, 410, 439; 215/12.1, 12.2; 446/267, 197

[56] References Cited

U.S. PATENT DOCUMENTS

| | | | |
|---|---|---|---|
| 2,744,391 | 5/1956 | Deane | 215/12.1 |
| 2,991,574 | 7/1961 | Trame | 40/406 |
| 4,198,993 | 4/1980 | Martin et al. | 215/12.1 |
| 4,402,195 | 9/1983 | Campbell | 215/12.1 |

*Primary Examiner*—James R. Brittain
*Assistant Examiner*—J. Hakomaki
*Attorney, Agent, or Firm*—Harness, Dickey & Pierce

[57] ABSTRACT

A decorative cup is formed by attaching a fluid filled tank to the exterior of a cup. The tank also contains decorative particles suspended in the fluid. A pump that agitates the fluid and particles is built into a handle.

19 Claims, 3 Drawing Sheets

DECORATIVE CUP

FIELD OF THE INVENTION

The invention pertains to the field of decorative drinking vessels and more particularly to a cup, the exterior of which is decorated with a compartment for agitable fluid.

BACKGROUND OF THE INVENTION

Fluid filled toys are well known and take several forms. A simple form is the fluid filled container with small particles. Typically, the container has a plastic base with a small scene molded into it. A transparent dome covers the base and the scene. The container is filled with water and white flakes. When the container is shaken the particles are agitated and simulate the appearance of snowfall on the scene.

More recent toys use a hand operated pump to push small objects about in a transparent water filled tank. Various games can be based on these devices as disclosed in U.S. Letters Pat. No. 4,032,141 to Tanimura and U.S. Letters Pat. No. 4,142,715 to Matsumoto.

These water filled toys are bulky and have no practical utility beyond simple amusement. The present invention incorporates a decorative fluid tank into a drinking cup. The resulting device adds decoration and amusement to the everyday routine process of drinking fluids.

SUMMARY OF THE INVENTION

The present invention is a decorative drinking cup. A fluid-filled cavity independent of the recess which holds the beverage is attached to the exterior of the cup. More specifically, the present invention comprises a decorative cup which includes an inner wall that defines a chamber for holding a beverage and an outer wall spaced apart and surrounding the inner wall. The outer and inner walls are sealed together at their respective tops and bottoms to form a sealed cavity. This cavity is preferably substantially filled with fluid and with decorative particles. However, the cavity will have a head space above the fluid level filled with a compressible fluid, such as air, to permit the pumping of fluid into the cavity. A handle is fastened to the outside of the cup which includes a pump. The pump is connected to the sealed cavity so that activating the pump agitates the fluid in the cavity. The fluid, in turn, agitates the particles creating a dynamic decorative effect.

DETAILED DESCRIPTION OF THE INVENTION

Figure 1:
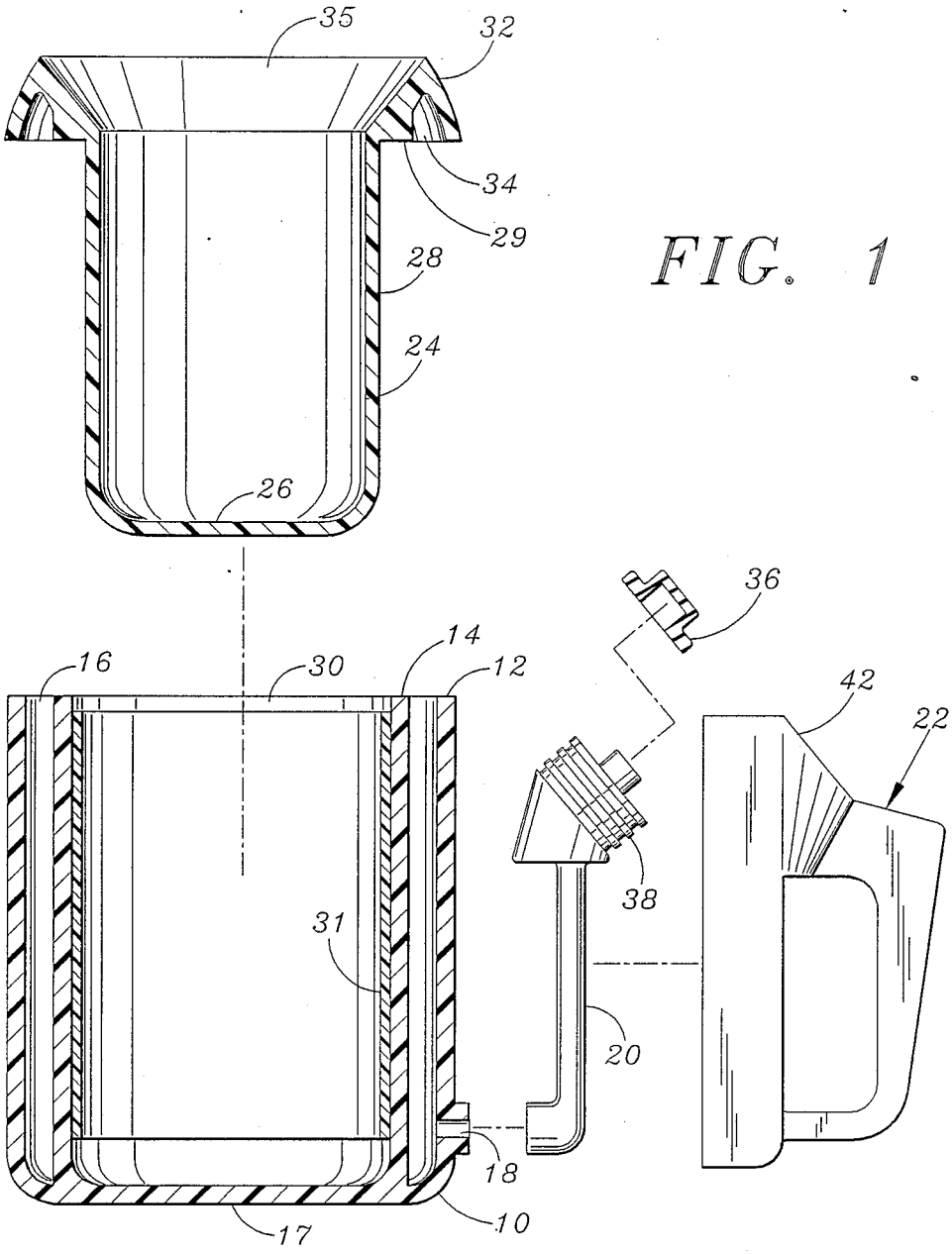
FIG. 1 is a side sectional view of the decorative cup of the present invention in a preferred embodiment.
Figure 4:
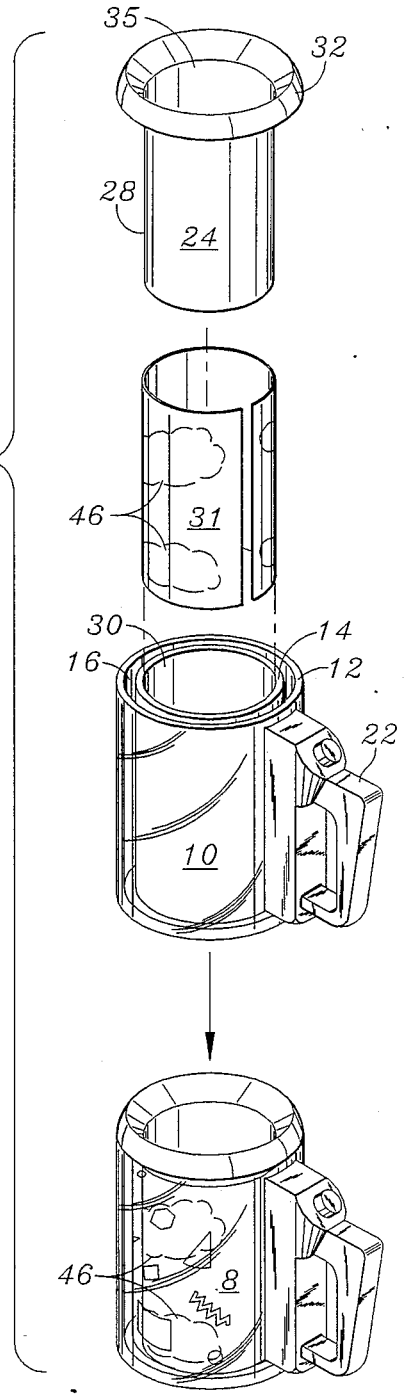
FIG. 4 is the perspective view of the decorative cup of the present invention broken down into its component parts, namely, an insert, a liner, a body and, finally, the assembled cup.

The construction of an exemplary embodiment of the present invention is depicted in FIGS. 1 and 4. Referring to FIG. 4, the decorative cup is composed of a main body 10, an insert 24 and a sheet liner 31 disposed between the side wall 28 of the insert 24 and inner wall 14 of the main body 10. As described below, the insert is disposed within the main body. The main body 10 is a transparent plastic double cylinder with a base 17 capping the bottom end. The double cylinder is formed by a cylindrical inner wall 14 and a cylindrical outer wall 12 spaced apart from the inner wall. The outer wall 12 completely surrounds the inner wall 14. The space 30 within the inner wall 14 is adapted to receive a cup insert 24. The cavity 16 between the inner and outer walls is adapted to hold a fluid as described in more detail below. Near the bottom of the cavity is an outlet 18 which connects the cavity 16 with an outlet tube 20. The outlet tube 20 leads to a bellows pump 38. The bellows pump is compressed with a thumb switch 36 which is directly connected to one end of the bellows pump.

The cup insert 24 has a side wall 28. At the top of the cup insert is a flange 29 and an outer rim 32. The flange 29 sealably joins with the inner wall 14 and the outer rim 32 sealably joins with the outer wall 12 of the base 10, so that, when the cup insert 24 is placed in the main body 10, the cavity 16 between the inner and outer walls is sealed by the flange 29 and the inner wall 14 on the inside, and the outer rim 32 and the outer wall 12 on the outside. The groove 34 between the flange 29 and the rim 32 becomes an integral part of the sealed cavity 16 which surrounds the interior recess 35 of the cup. Preferably the cavity 16 is filled with a fluid up to the bottom of the groove 34, and the head space above the fluid occupies the space in the groove. When the cup insert 24 is installed in the main body 10, a beverage can be contained in the interior recess 35 and a decorative fluid can be contained within the sealed cavity 16.

The two part construction of the cup using a main body and a separate insert allows the cavity 16 to be filled with fluid after the individual parts are molded. The cavity is sealed when the insert is installed. The two part construction also allows a sheet-like liner 31 to be placed between the sidewall 28 and the inner wall 14. If both the inner and outer walls are primarily transparent then the liner will be clearly visible from the outside of the cup. The liner may be printed with words, pictures or patterns such as the cloud pattern 46 shown is FIGS. 3 and 4. The liner may be opaque, translucent or a combination of both. Different liners may be made interchangeable when the insert can be removed from the main body and replaced without damage.

Figure 2:
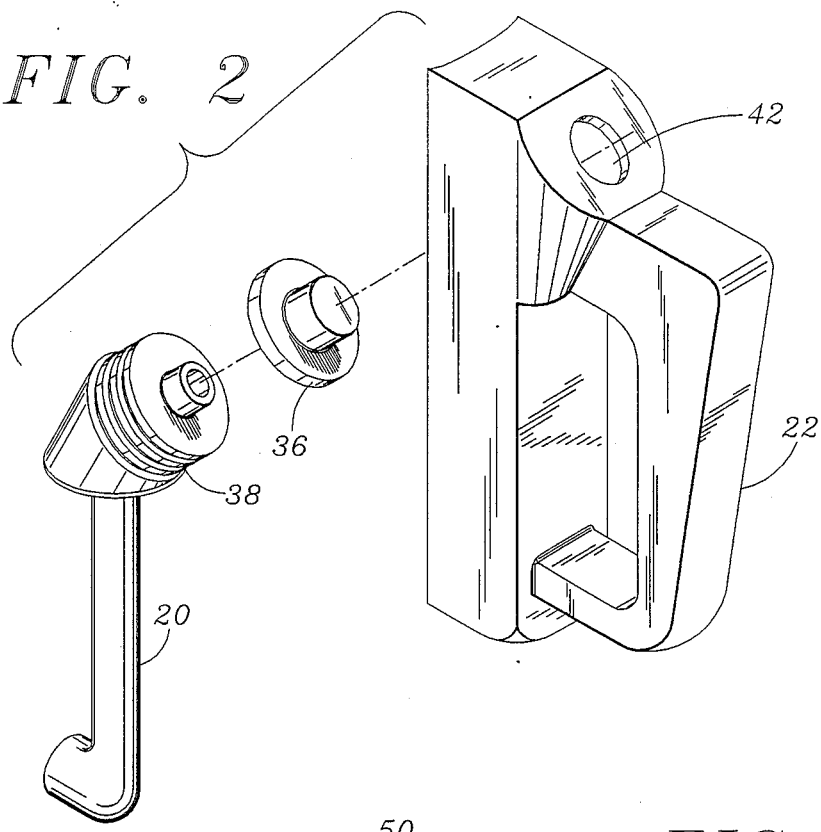
FIG. 2 is a perspective view of the handle assembly of the decorative cup of the present invention.

The bellows pump 38 and outlet tube 20 are covered by a handle 22. The handle is mounted on the outer wall 12 of the drinking cup so that the entire cup assembly can be held comfortably in the hand. As shown in FIG. 2, the handle 22 is provided with a hole 42 through which the thumb switch 36 protrudes. As a result, a person, gripping the handle 22 in the conventional manner, can easily depress the thumb switch 36 with his or her hand to agitate the fluid in the sealed cavity 16.

The handle and pump assembly can be adapted to allow the cavity to be refilled with fluid. Making the handle, the thumb switch, and the bellows pump removable allows direct access to the cavity through the outlet tube. In the alternative, a closeable port (not shown) may be provided, for example, on the outer wall, through which the cavity may be filled.

Figure 3:
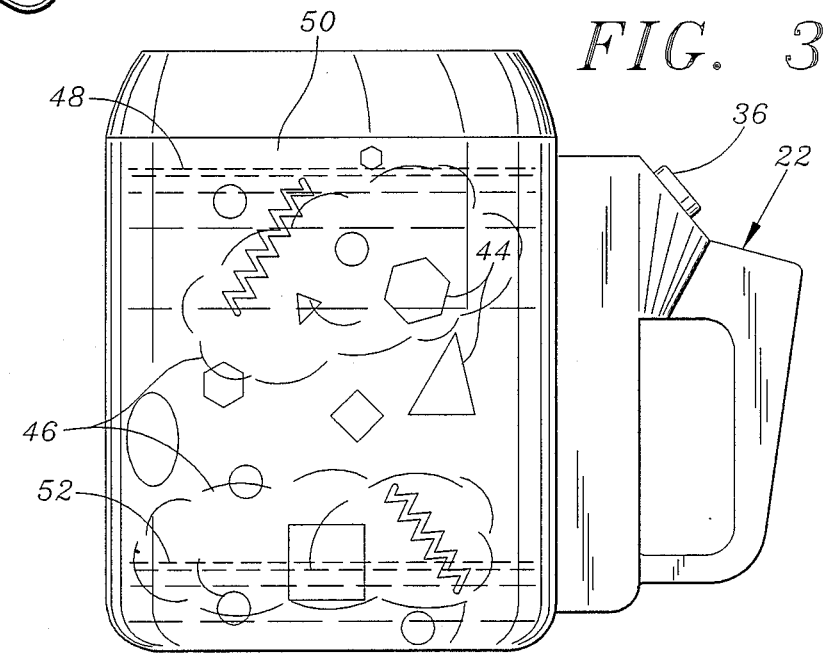
FIG. 3 is a side elevation view of the present invention in a preferred embodiment.

As shown in FIG. 3, the cavity 16 extends around the full circumference of the cup in the present embodiment. The cavity is therefore visible from all directions. However, the cavity can be many different shapes to achieve different visual effects.

In operation, the cavity 16 is almost completely filled with fluid 48. The fluid also fills the outlet tube 20 and the bellows pump 38. However, there is an air space 50 in the groove 34 between the flange 29 and the rim 32 of the cup insert. When the thumb switch is depressed the fluid in the bellows pump is forces out of the pump and down the outlet tube toward the cavity. The moving fluid creates currents through the cavity. These currents create a dynamic decorative effect. The air in the groove compresses to compensate for the compression at the bellows and to allow the fluid from the pump to move into the cavity. The pumping action can also be achieved with a piston pump, such as the pumps described in U.S. Pat. Nos. 4,032,141 and 4,172,715. Compressing a piston of a piston pump using a switch similar to switch 36 would have virtually the same effect.

Figure 5:
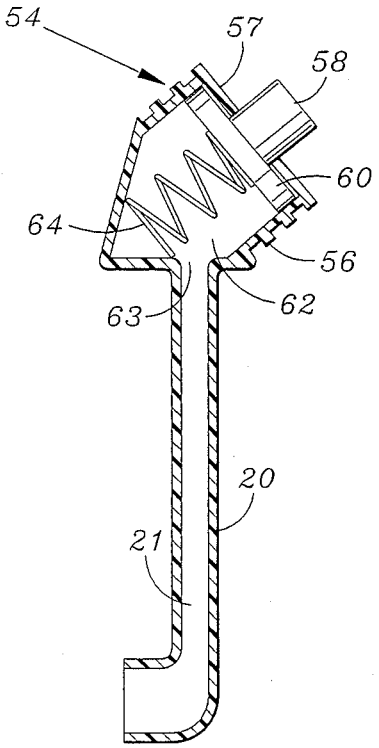
FIG. 5 is a side sectional view of a piston pump that can be mounted in the handle of the present invention for pumping fluid into the cavity.

Piston pump 54 of FIG. 5 comprises a body 56 having a central plenum chamber 62 in fluid communication through opening 63 with the central bore 21 of outlet tube 20 which is connected to the outlet 18 of the cavity as described with respect to the bellows pump above. In the plenum chamber, there is a piston 60 which is connected to an actuator pin 58 which extends from the piston through the face plate 57 of the body. The actuator pin is designed to be received by the thumb switch 36 in the handle 22. In the bottom of the plenum chamber, there is situated a return spring 64 which biases the piston toward the face plate 57. The piston is depressed by pushing the actuator pin 58 toward the face plate which will force fluid out of the plenum chamber down through the central bore of the outlet tube 20 into the outlet 18 and into the cavity of the cup.

As shown in FIG. 3, decorative particles 44 can be placed in the cavity so that when the thumb switch 36 is depressed and the fluid in the cavity 16 is agitated, the decorative particles 44 are picked up by the fluid currents to enhance the decorative effect. The particles can be made of plastic, wood or metal. Colored plastic in decorative shapes, such as spheres, ribbons, rings, triangular discs, circular discs, spiral ribbons and the like, is preferred however. Colored fluid can also be used decoratively. Either a single colored fluid 50 or several different colored immiscible fluids such as second immiscible fluid 52 as shown in FIG. 3 can be used. For example, the cavity could be filled with mineral oil and water. The fluid currents will cause the interfaces between the immiscible fluids to change to create complex and attractive designs.

The exemplary embodiment described above is made primarily of transparent thermoplastic. The parts are joined and sealed by thermal welding and most of the parts are round or cylindrical. The cup is therefore inexpensive to manufacture and the decorative particles are easy to observe. However, other shapes and materials may be used instead.

The cup may be made square or hexagonal or any number of other shapes. The cup may be fitted with a rounded, recessed or otherwise shaped bottom, and the fluid filled cavity may be made to cover only a portion of the cup's exterior.

The cup may also be made of different materials such as ceramic or glass. These materials may be glued or fused together. While the exemplary embodiment is primarily transparent, opaque materials may be used in a number of locations to further enhance the decorative features of the cup, for example, the base 17 and the handle 22. Translucent materials may be combined with opaque or transparent materials throughout to create different visual effects. For example, the cup insert 24 can be made of translucent material so that the beverage may be seen from the cup exterior. Alternatively, a colored opaque liner may be placed between the sidewall and the inner wall. The cup can also be made from a transparent or translucent outer piece comprising the base 17 and outer wall 12 and a transparent, translucent or opaque (preferably having a high reflectance value) inner piece comprising the inner wall 14.

In another embodiment the cup may be made as one piece rather than two. Instead of a main body and an insert as in the exemplary embodiment, the cup may be formed of a single double walled unit with the space 30 adapted to hold a beverage. The outer wall may be made with a closeable hole for filling the cavity with fluid or the cavity may be filled through the pump. A one-piece construction is simpler and may be less expensive to manufacture.

In the alternative, the two-piece construction can be maintained, but the second piece, the cup insert, can be greatly simplified. Instead of the insert described above, a simple ring adapted to fit over the cavity and sealed to the inner and outer walls can be used. The main body can be made substantially as described above. The beverage is then contained in the space 30.

While this description has been limited to only a few embodiments of the present invention, it is understood that many other embodiments and variations are possible without departing from the spirit and scope of the present invention as presented in the following claims.

What is claimed is:

1. A cup comprising a base;

an inner wall, defining together with the base a recess for holding a beverage;

an outer wall connected to the inner wall, defining together with the inner wall a cavity, the cavity partially filled with liquid fluid surmounted by an air space, said outer wall being at least partially transparent;

a pump in communication with the cavity, the pump, upon activation, capable of forcing liquid fluid into the cavity and compressing the air space to create currents in any fluid in the cavity;

a handle affixed to the outer wall; and means on said handle for activation of the pump.

2. The cup of claim 1 wherein the cavity also contains decorative particles that are moved by currents in the fluid.

3. The cup of claim 1 wherein the cavity is sealed.

4. The cup of claim 1 wherein the inner wall is at least partially transparent.

5. The cup of claim 1 wherein the cup is made substantially of plastic.

6. A cup comprising:

a base;

an outer wall mounted to the base, the outer wall including an outlet there through, said outer wall being at least partially transparent;

a handle affixed to the outer wall;

an inner wall mounted to the base within the outer wall and spaced apart from the outer wall, the inner wall and the base together forming a recess for holding a beverage, and the inner wall, the outer wall and the base together forming a cavity between the inner wall and the outer wall, the cavity partially filled with liquid fluid surmounted by an air space;

and a pump located in the handle coupled to the cavity through the outlet, the pump upon activation capable of forcing liquid fluid into the cavity an compressing the air space to generate currents in the fluid in the cavity, and means on said handle for activation of the pump.

7. The cup of claim 6 wherein the pump comprises a bellows and the currents are generated by manually depressing the bellows.

8. The cup of claim 6 wherein the pump comprises a piston and the currents are generated by manually depressing the piston.

9. The cup of claim 6 in which the cavity contains decorative particles.

10. The cup of claim 6 wherein the cavity is at least partially filled with at least two distinct immiscible fluids.

11. The cup of claim 6 wherein the cavity is sealed.

12. The cup of claim 6 wherein the inner wall is at least partially transparent.

13. The cup of claim 6 wherein the outer wall is at least partially transparent and the inner wall is at least partially opaque.

14. A cup comprising:

a main body, the main body including a base, an inner wall mounted to the base, the inner wall together with the base defining a space having a closed end and opposing open end, an outer wall mounted to the base, the outer wall having an outlet, the outer wall being at least partially transparent and the outer wall, together with the inner wall and the base, defining a cavity substantially closed at the base and substantially open at the top opposite the base, the cavity partially filled with liquid fluid surmounted by an air space, a handle affixed to the outer wall;

an insert adapted to hold a beverage, place substantially in the space within the inner wall, the insert including a bottom, a continuous sidewall extending up from the bottom, the sidewall, together with the bottom, defining a recess having an open end for holding a beverage, a rim connected to the top of the sidewall, the rim extending over the top of the cavity and substantially sealing the cavity, a liner located between the side wall of the insert and inner wall of the main body;

a pump located in the handle and coupled to the cavity through the outlet, the pump upon activation forcing fluid into the cavity and compressing the air space to create currents in the fluid, and means on said handle for activation of the pump.

15. The cup of claim 14 in which the pump comprises a bellows, the currents being generated by manually depressing the bellows.

16. The cup of claim 14 in which the pump comprises a piston, the currents being generated by manually depressing the piston.

17. The cup of claim 14 in which the cavity is at least partially filled with at least two immiscible fluids.

18. The cup of claim 14 in which the inner wall is at least partially transparent.

19. The cup of claim 14 in which the cavity contains decorative particles.

* * * * *